United States Patent [19]

Rebollo

[11] Patent Number: 4,685,728

[45] Date of Patent: Aug. 11, 1987

[54] SELF-CONTAINED OUTDOOR SPORTS EVENT SEAT

[76] Inventor: Juan G. Rebollo, 633 Mission, El Paso, Tex. 79905

[21] Appl. No.: 761,756

[22] Filed: Aug. 2, 1985

[51] Int. Cl.[4] ..... A47C 1/16; A47C 7/66

[52] U.S. Cl. ..... 297/184; 52/2; 137/625.23; 137/625.24; 297/217; 297/DIG. 3

[58] Field of Search ..... 297/184, 217, DIG. 3; 52/2; 137/625.23, 625.24

[56] References Cited

U.S. PATENT DOCUMENTS

| | | | |
|---|---|---|---|
| 679,247 | 7/1901 | Whiting | 137/625.24 |
| 3,155,427 | 11/1964 | Necessary | 297/184 |
| 3,540,170 | 11/1970 | Flowers | 52/2 |
| 3,629,875 | 12/1971 | Dow | 52/2 X |

FOREIGN PATENT DOCUMENTS

| | | | |
|---|---|---|---|
| 2605951 | 8/1977 | Fed. Rep. of Germany | 297/DIG. 3 |

*Primary Examiner*—Kenneth L. Dorner
*Assistant Examiner*—Peter R. Brown
*Attorney, Agent, or Firm*—Hill, Van Santen, Steadman & Simpson

[57] ABSTRACT

A portable inflatable stadium type seat including an airtight hollow base which provides a pressure chamber, the pressure chamber being arranged to introduce air under pressure into a plurality of flexible, double-walled panels secured to a base which also functions as a seat. The panels are arranged to be assembled into a protective enclosure including a canopy structure for the user which overlies the base. The panels, when assembled, are mechanically coupled together by suitable fastening means. Air is introduced under pressure independently from the pressure chamber into each of the panels to inflate the same into the protective enclosure.

7 Claims, 9 Drawing Figures

FIG. 1
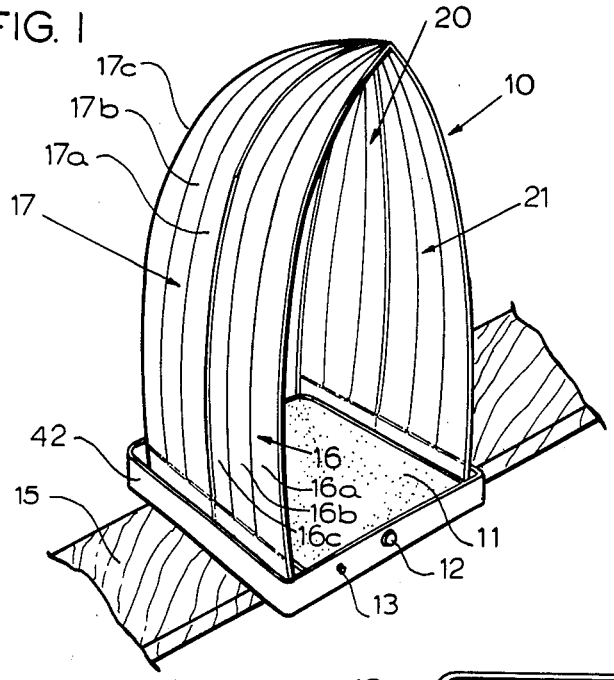
FIG. 4
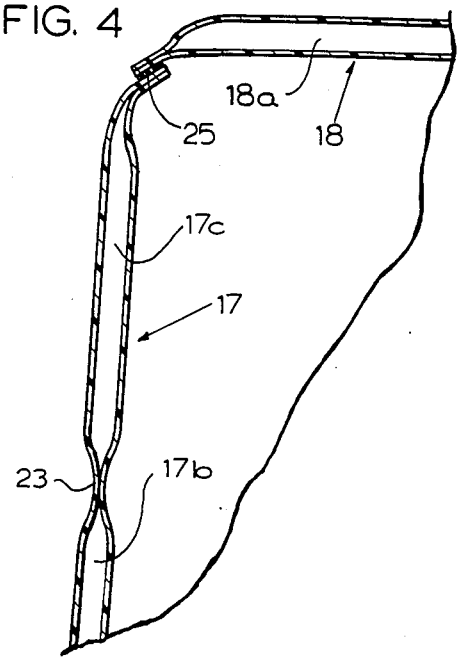
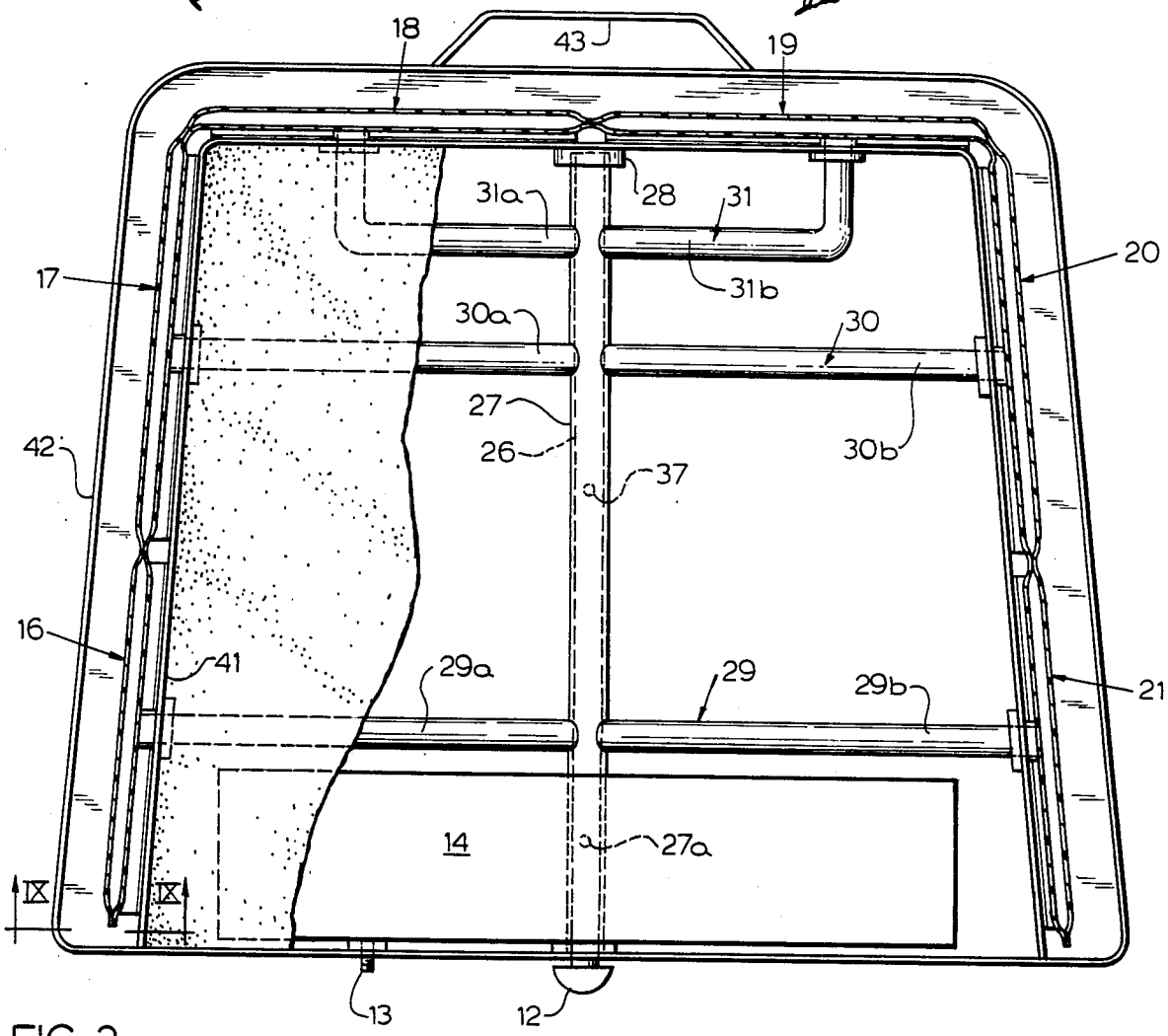
FIG. 2

FIG. 6
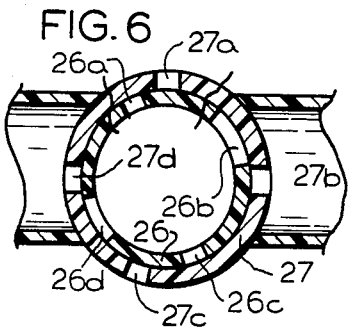
FIG. 7
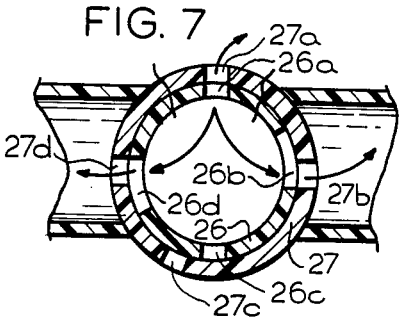
FIG. 8
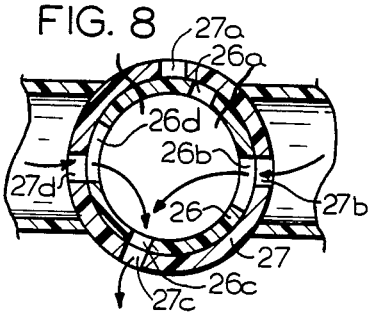
FIG 3
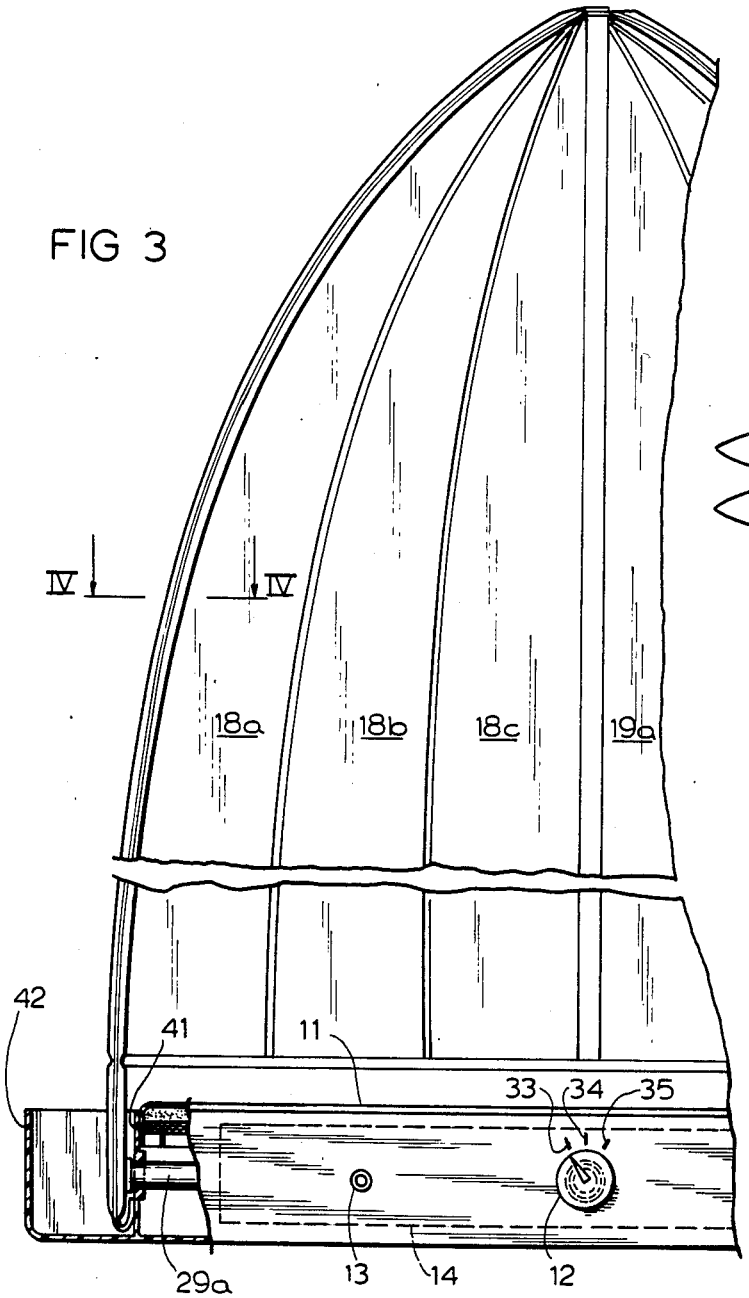
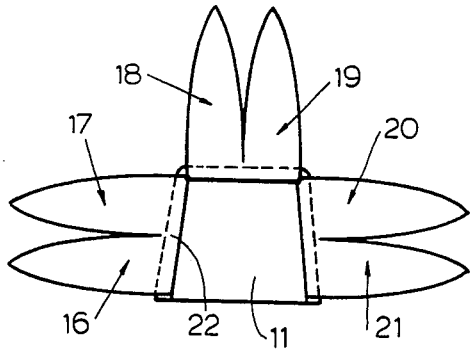
FIG. 5
FIG. 9
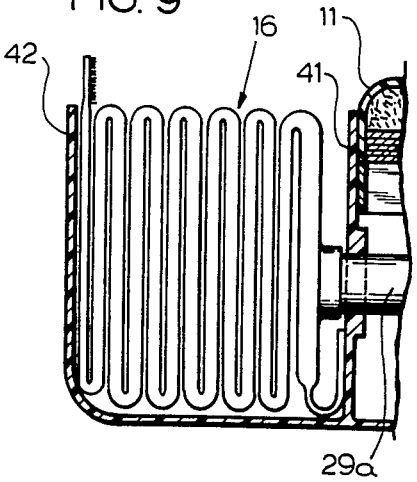

SELF-CONTAINED OUTDOOR SPORTS EVENT SEAT

BACKGROUND OF THE INVENTION

1. Field of the Invention

The present invention is in the field of portable stadium type seats used to protect the user against the elements and includes the combination of a base structure which provides a seat portion, and flexible, transparent panels which, upon inflation, form a protective enclosure for the user including a canopy above the user's head. Means are provided for selectively inflating the panels independently of each other while inflating and forming a half shell enclosure unit and for deflating the enclosure so that the panels can be folded into a channel incorporated in the upper portion of seat member for easy, compact carrying.

2. Description of the Prior Art

Spectators at outdoor stadia, such as for sporting events or the like, are at the mercy of the elements. It is not uncommon for the spectators to be subject to high winds, rain, snow, or other atmospheric disturbances while attending the athletic event or other performance.

Some prior art patents have been directed to stadium type seats which includes U.S. Pat. No. 3,052,251 to De Jean; U.S. Pat. No. 3,155,427 to Necessary; U.S. Pat. No. 3,580,633 to Du Priest, and U.S. Pat. No. 3,768,860 to Barker. The broad idea of providing a seat and a shelter is disclosed in the DeJean, Necessary, and Barker patents. Each provides a frame which rests on a stadium bench upon which the spectator sits. Weatherproof sheeting is secured to the frame to keep the spectator dry. The sheeting is either transparent, or a window is provided for viewing.

Hann. U.S. Pat. No. 2,350,679 discloses an inflatable chair with inflatable side edge portions and fabric stretched between them so as to form a seat and back for the chair. Forsyth in U.S. Pat. No. 2,627,302 disclosed a pneumatic seat cushion which included a plurality of inflatable sections. In U.S. Pat. No. 3,608,966 Kredenser disclosed a collapsible chair construction which included a plurality of inflatable sections.

SUMMARY OF THE INVENTION

The present invention provides a self-contained outdoor seat such as could be used in a stadium with a dome or canopy arrangement to protect the user against foul weather. The improved seat of the present invention is constructed of a plurality of separate, double-walled clear plastic panels which are individually filled with air from a single source. The source of pressurized air is a common air reservoir tank which is located inside a rigid, one-piece molded structure which functions as a seat base. The improved chair of the invention, when inflated, is held erect by the air pressure from the air reservoir unit in the seat's base.

More specifically, the present invention provides a portable, self-contained, inflatable outdoor sports event seat utilized for protection in inclement weather. Means are provided for introducing air under pressure into panels, comprising the half shell enclosure. A plurality of flexible, double-walled panels are secured to the seat base and are joined together to be inflated into a protective enclosure, the canopy structure overlying the base to protect the head of the user.

The seat assembly may include an outer channel in spaced relation to the base, the space between the base and the outer channel providing a space for stowing the half shell enclosure when the panels are deflated, making the entire seat into a very compact structure for carrying and storage.

In a preferred embodiment of the present invention the seat includes a control means which is connected to the air reservoir tank, and a plurality of conduits connecting each of the panels individually to the control means to control the flow of pressurized air in and out of the panels. The control means has a first position in which airflow into the feed lines is prevented, a second position in which airflow occurs into the conduits from the pressurized air source, and a third position in which air is discharged from the conduits through the control means upon collapse of the panels. This control means may take the form of a pair of concentric tubes, one being an outer rigidly mounted ported tube and the second being an inner concentric tube having ports arranged to selectively register with the ports in the outer tube, depending upon the passage of air into and out of the panels.

BRIEF DESCRIPTION OF THE DRAWINGS

A further description of the present invention will be made in connection with the attached sheets of drawings which illustrate a preferred embodiment and, in which:

FIG. 1 is a view in perspective of the stadium seat in its inflated condition supported on a bench;

FIG. 2 is a plan view of the bottom of the stadium seat, partially broken away, to illustrate the interior construction;

FIG. 3 is a partial view in elevation of the stadium seat, partially in cross section;

FIG. 4 is a fragmentary cross-sectional view taken substantially along the line IV—IV of FIG. 3;

FIG. 5 is a plan view of the seat in its totally collapsed condition, illustrating the configuration of the panels in their deflated condition;

FIG. 6 is a fragmentary cross-sectional view of a control member which can be used in conjunction with the present invention, the control member being in the inflated or hold position;

FIG. 7 is a view similar to FIG. 6 but illustrates the control member in the inflating condition when pressure is being directed into the individual panels;

FIG. 8 is a view similar to FIGS. 6 and 7 but illustrating the position of the control element when the panels are being deflated; and FIG. 9 is a fragmentary view of the base of the stadium seat when the panels are folded into a compact package.

DESCRIPTION OF THE PREFERRED EMBODIMENTS

Turning first to FIG. 1, reference numeral 10 indicates generally the improved stadium type seat of the present invention which includes a rigid base 11 constructed of a molded plastic such as a glass reinforced synthetic resin. The top of the base 11 provides a seating surface for the user. The base is proportioned to be received conveniently on a bench 15 or an individual folding type chair.

The front portion of the base 11 includes a control knob 12 for selectively introducing and discharging air from the inflatable panels as will be hereinafter described, and a compressed air inlet valve 13 of the type, for example, common tire inlet valve. As best seen in FIG. 2, the inlet 13 is arranged to introduce pressurized air into the air reservoir tank.

In the form of the invention shown in FIGS. 1 and 5, the protective structure consists of a series of six double-walled panels 16 through 21 as best illustrated in FIG. 5. These panels may be joined to adjacent panels by means of lines of heat sealing 22 at their lower edges and along mating edges of the panels, to their peak.

In turn, each of the panels 16 through 21 may be composed of individual subpanels such as subpanels 16*a, b* and *c;* subpanels 17*a, b,* and *c,* and so on. The provision of these subpanels prevents a ballooning effect which would occur if the panels were of substantial width and length. The individual subpanels are joined together at the bottom by heat sealing, while providing a basis for influx of compressed air into the individual subpanels.

The panel sections in their assembled relation as shown in FIG. 1 are joined together by common heat-sealing procedures along their mating edges.

The interior structure of the base is best illustrated in FIG. 2 of the drawings. It will be seen that the control knob 12 operates to rotate an inner, ported tube 26 which is mounted within a rigid outer rube 27 by means of a mounting bracket 28. The inner tube 26 is free to rotate relative to the outer tube 27, but is constrained against axial movement therein. The relative position between the inner tube 26 and the outer tube 27 determines the flow of air into and out of the system. A plurality of conduits 29, 30 and 31 are sealingly engaged with the outer tube 27. The tube 29 and tube 29*a* feed the panel 16, and the panel 21. Similarly, the tube 30 and the tube 30*a* the panel 17 and the panel 20. Feed line 31 and feed line 31*a* feed panels 18 and 19, respectively.

The relative positioning between the inner tube 26 and the outer tube 27 in various conditions of operation is best illustrated in FIGS. 6 through 8 of the drawings. As seen, the inner tube 26 is provided with ports 26*a, 26b, 26c* and 26*d*. These are arranged to register with ports 27*a, 27b, 27c* and 27*d* of the outer tube 27. In the condition shown in FIG. 6, none of the ports of the inner tube 26 registers with the ports in the tube 27 so that no airflow exists through the control element. This is the positioning which exists when the panels have been filled with air and no further ingress or egress of compressed air is desired. In the situation shown in FIG. 7, the port 26*a* is moved into registry with the port 27*a,* the port 26*b* into registry with the port 27*b,* and the port 26*d* into registry with the port 27*d*. The port 27*a* is located in the air reservoir tank 14 (FIG. 2) so that compressed air can travel as indicated by the arrows into the interior of the inner tube 26 and passes through the ports 27*b* and 27*d,* respectively, whereupon the feed lines 29, 30 and 31 are supplied with compressed air from the air reservoir 14. After sufficient air has been injected into the panels to inflate them into the upstanding position shown in FIG. 1, the control knob 12 is moved to the position shown in FIG. 6 to shut off all fluid communication between the air reservoir tank 14 and the panels. The control knob shown in FIG. 3 may be provided with indicia 33 through 35 on the base 11 to indicate the inflated condition, the inflating condition and the deflating condition, respectively.

In the deflating condition shown in FIG. 8, air supply from the air reservoir 14 is cut off because the port 26*a* is no longer in communication with the port 27*a*. Ports 26*b* and 26*d,* however, are still in communication with ports 27*b* and 27*d* so that airflow can occur from the inflated panels into the inner tube 26. In this position of the control element, port 26*c* is in registry with port 27*c* so that the air in the inner tube 26 can be vented to the atmosphere through a discharge opening 37 as shown in FIG. 2.

Positioned alongside the base 11 is an inner channel member 41 to which the lower ends of the panels are secured. A spaced outer channel member 42 provides a receptacle which accommodates the panels for storage purposes as shown in FIG. 9. The half shell unitized structure can be tucked manually and stored conveniently in the space between the inner channel 41 and the outer channel 42. A handle 43 may be provided to facilitate carrying the collapsed and folded seat structure conveniently.

In use, the user merely supplies air from an air hose through the inlet valve 13 until a predetermined air pressure is reached. Then, when the half shell enclosure is to be unfolded, the control member 12 is moved to the inflate position where the control elements are in the position shown in FIG. 7. This causes the pressurized air to enter each of the separate, inflatable panels 16 through 21, and assume the shape shown in FIG. 1. After filling, the control element is moved to the position shown in FIG. 6 where the pressurized air is maintained for as long as the unit is in use. Then, when the unit is to be folded, the control element is moved to the position shown in FIG. 8 where the air is vented from the panels 16 through 21 through the discharge opening 37 and the half shell enclosure is collapsed and folded into the space between the inner channel member 41 and the outer channel member 42.

The seat structure of the present invention thus provides a self-sustaining dome structure for protecting the user against inclement weather. There is a built-in storage channel in the seat for stowing the dome when not in use. There are no projecting portions in the dome which might pose a hazard to the user or to the surrounding spectators. The panels though individually inflated are joined to each other so that damage to one panel does not affect the others. The seat is proportioned to fit on a standard folding chair or conventional stadium seating area. The entire dome structure is flexible so that it accommodates some movement upon pressure from the inside or outside. The half shell enclosure structure provides a minimal obstruction, and since it is composed of clear plastic material, the user's visibility is unimpaired. What is more, the dome structure is readily inflatable and deflatable by simple operations not requiring any braces or supports whatsoever.

Obviously, many additional features can be added to suit the user's purposes. For example, there can be additional facilities provided in the hollow area of the base seat for personal effects. Furthermore, an air cushion seat can be provided as part of the enclosure. It is possible to use a leg protector sheet which will snap on or otherwise be detachably secured to the assembly.

It will be evident that various modifications can be made to the described embodiments without departing from the scope of the present invention.

I claim as my invention:

1. A portable, inflatable stadium type seat comprising:

a rigid hollow base including spaced apart walls defining an air tight air reservoir, inlet means connected to said hollow base for introducing pressurized air into said air reservoir, a plurality of double-walled panels secured to said base and comprising tapered end portions, said panels upon assembly providing a half shell enclosure including a canopy of reduced cross-sectional area at its upper end, fastening means for releasably securing said double-walled panels into said half shell enclosure, a pressure manifold communicating with said air reservoir, and a plurality of conduits extending from said manifold and arranged to introduce pressurized air from said pressure manifold into the individual double-walled panels to inflate the same, said panels when inflated providing the sole mechanical support for supporting the panels in the form of said half shell enclosure.

2. A seat assembly according to claim 1, wherein said pressurized air control means has a first position in which pressurized air flow into said air conduit means is prevented, a second position in which pressurized air flows from said pressurized air reservoir means into said air conduit means and into said panels, and a third position in which air is discharged from said air conduit means to deflate said panels.

3. A seat assembly according to claim 2 wherein said pressurized air control means includes an outer, rigidly mounted ported tube and an inner concentric tube having ports therein arranged to selectively register with said ports in said outer tube.

4. A portable, self-contained, inflatable outdoor sports event seat for individual protection from the elements comprising:

a rigid, one piece, hollow seat member having an inside surface and an outside surface;

pressurized air reservoir means fixedly attached to said inside surface of said hollow seat member;

pressurized air inlet means passing through said hollow seat member into said pressurized air reservoir means;

a plurality of inflatable panels secured to said seat member and having a tapered configuration at their extreme ends, a plurality of air conduit means connecting said pressurized air reservoir means to said panels;

pressurized air control means communicating with said pressurized air reservoir means capable of sealing said pressurized air reservoir means and of conducting pressurized air from said pressurized air reservoir means to said panels and of discharging pressurized air from said panels;

wherein said panels may be inflated to form a self-supporting half shell protective enclosure.

5. A seat assembly according to claim 1 wherein said panels are composed of a transparent plastic material.

6. A seat assembly according to claim 4 which includes an outer channel and an inner channel in spaced relation and contiguous with said outside surface of said seat member, the space between said inner channel and said outer channel providing a space for storing said panels when said panels are deflated.

7. A seat according to claim 4, wherein said hollow seat member comprises a rigid plastic formed to accommodate the body of the user.

* * * * *